US009620311B2

(12) United States Patent
Ediger et al.

(10) Patent No.: US 9,620,311 B2
(45) Date of Patent: Apr. 11, 2017

(54) SWITCH LOCK MECHANISM

(71) Applicant: VORNADO AIR LLC, Andover, KS (US)

(72) Inventors: Glen W. Ediger, North Newton, KS (US); Gary P. Israel, Andover, KS (US); Timothy Holub, Cheney, KS (US); Jerald W. Ashton, Wichita, KS (US); Brian M. Cartwright, Wichita, KS (US); Russell Demitras, Andover, KS (US)

(73) Assignee: Vornado Air LLC, Andover, KS (US)

( * ) Notice: Subject to any disclaimer, the term of this patent is extended or adjusted under 35 U.S.C. 154(b) by 0 days.

(21) Appl. No.: 14/962,274

(22) Filed: Dec. 8, 2015

(65) Prior Publication Data

US 2016/0172132 A1 Jun. 16, 2016

Related U.S. Application Data

(60) Provisional application No. 62/090,123, filed on Dec. 10, 2014.

(51) Int. Cl.

| | |
|---|---|
| ***H01H 23/04*** | (2006.01) |
| ***H01H 23/14*** | (2006.01) |
| ***H01H 9/22*** | (2006.01) |
| *H01H 3/20* | (2006.01) |

(52) U.S. Cl.
CPC ..... *H01H 23/143* (2013.01); *H01H 9/223* (2013.01); *H01H 3/20* (2013.01)

(58) Field of Classification Search
CPC ..... H01H 23/04; H01H 23/24; H01H 3/20; H01H 23/143; H01H 9/223
USPC ..... 200/43.16, 43.01, 43.02, 43.22
See application file for complete search history.

(56) References Cited

U.S. PATENT DOCUMENTS 4,978,816 A * 12/1990 Castonguay ..... H01H 9/282 200/43.14
2006/0070861 A1* 4/2006 Bogdon ..... H01H 9/282 200/43.16

* cited by examiner

*Primary Examiner* — Edwin A. Leon
*Assistant Examiner* — Iman Malakooti
(74) *Attorney, Agent, or Firm* — Milligan PC LLO

(57) ABSTRACT

A locking assembly for locking a switch is provided. According to a preferred embodiment, a locking member is connected to a support member having a plurality of first grooves, a lower receiving element, a retaining tab, a resilient member and a fastening element. Preferably, the lower receiving element includes a securing socket element having at least a second groove and a third groove. According to a preferred embodiment, the fastening element preferably secures the locking member, the lower receiving element, and the resilient member with a panel to form a locking assembly that automatically locks the switch when the switch is in a selected position.

6 Claims, 5 Drawing Sheets

SWITCH LOCK MECHANISM

RELATED APPLICATIONS

The present application claims priority to U.S. Provisional Application No. 62/090,123 filed Dec. 10, 2014.

FIELD OF INVENTION

The present invention is related in general to locking devices and, in particular, to a locking assembly that allows secure operation of switches.

BACKGROUND OF THE INVENTION

A switch is a manually operated electromechanical device with one or more sets of electrical contacts which are connected to external circuits. In operation, each set of contacts can be in one of two states: either closed (allowing electricity to flow between the contacts) or open (preventing electricity from flowing between the contacts). A rocker switch consists of a central bezel which rocks back and forth in response to pressure to open and close a circuit. Rocker switches are commonly used as light switches and they can be used in a variety of other appliances and surge protectors. Rocker switches are typically designed to be easily manipulated between an OFF position and an ON position. Due to the ease of manipulating a rocker switch, there are chances of such switches inadvertently remaining in the ON position and causing damage, shock or other injury to a user or connected apparatus.

A number of different locking mechanisms have been developed that are employed to protect users from hazardous situations. One such locking mechanism includes a rocker switch with a safety pin which can be slid forward to lock the rocker switch to prevent any unexpected or accidental depression of the switch. In these type of devices, the safety pin can generally be retracted to unlock the rocker switch. In use, these types of locking mechanisms are difficult to handle and they do not fully protect against the accidental tripping of the switch.

Another existing locking mechanism includes a switch lockout and rocker switch design that includes a switch cover, a rocker plate, a base and a lockout slide. In these designs, the rocker plate usually has opposite first and second ends, and is pivotally mounted to the cover. In this design, the rocker plate is allowed to pivot between oppositely tilted first and second tilted positions. To function, the slide in this design is selectively translatable relative to the base, being slidably mounted on the base for translation of the slide in a direction perpendicular to the pivot axis so as to slide relative to the rocker plate between a first lockout position and second lockout position. The disadvantage of this design is that the switch lockout has a complex construction. Additionally, this complex mechanism makes it difficult for a user to slide the rocker switch between the first lockout position and a second lockout position.

Based on the foregoing, there is a need for an improved locking mechanism that would automatically lock a switch when the switch is in an ON position. Such a locking mechanism would be easy to handle and would prevent the switch from being accidentally turned on. Such a mechanism would further allow the user to easily change the switch from an ON position to an OFF position and to lock the switch. Further, the mechanism would allow the user to lock the switch by sliding over the switch and unlock the switch by retracting back from the switch. Finally, the locking mechanism would be operable with a single hand and would protect the user from any hazardous situation. The present invention overcomes prior art shortcomings by accomplishing these critical objectives.

SUMMARY OF THE DISCLOSURE

To minimize the limitations found in the prior art, and to minimize other limitations that will be apparent upon the reading of the specification, the preferred embodiment of the present invention provides a locking assembly which allows secure operation of switches.

According to a preferred embodiment, a locking assembly is provided which includes: a locking member connected to a support member, a lower receiving element, a retaining tab, a resilient member having a first end and a second end, and a fastening element. Preferably, the locking member has a fixed end and a movable end. The fixed end of the locking member is preferably connected to the support member and the movable end is preferably cantilevered with minimal clearance to slide over the switch when the switch is in an OFF position.

According to a further preferred embodiment, the support member may preferably include one or more projections. Further, the lower receiving element may preferably further include: a securing socket element which includes one or more receiving grooves; and a spring groove. In use, the projection(s) in the support member may preferably engage with the retaining groove(s) in the securing socket element to secure the locking member and to apply force to the locking member. Preferably, the locking member via its attached support member is further secured to the lower receiving element using a fastener.

In accordance with a further preferred embodiment of the present invention, the movable end of the locking member preferably slides over the switch when the switch is in the OFF position thereby locking the assembly in the OFF position. Preferably, the switch cannot be activated to an ON position until the locking member is rotated out of its locking position.

In accordance with a further preferred embodiment of the present invention, the locking mechanism preferably requires the user to apply pressure to the locking member to move the locking member away from the rocker member and to thereby turn the switch ON. Preferably, this pressure is transferred and stored in the resilient member. Conversely, when the switch is turned OFF, the pressure on the resilient member is preferably released thereby automatically sliding the locking member over the switch and locking the switch without any additional operation.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and to improve the understanding of the various elements and embodiments of the invention. Furthermore, elements that are known to be common and well understood to those in the industry are not depicted in order to provide a clear view of the various embodiments of the invention. Thus, it should be understood that the drawings are generalized in form in the interest of clarity and conciseness.

DETAILED DESCRIPTION OF THE DRAWINGS

In the following discussion that addresses a number of embodiments and application of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
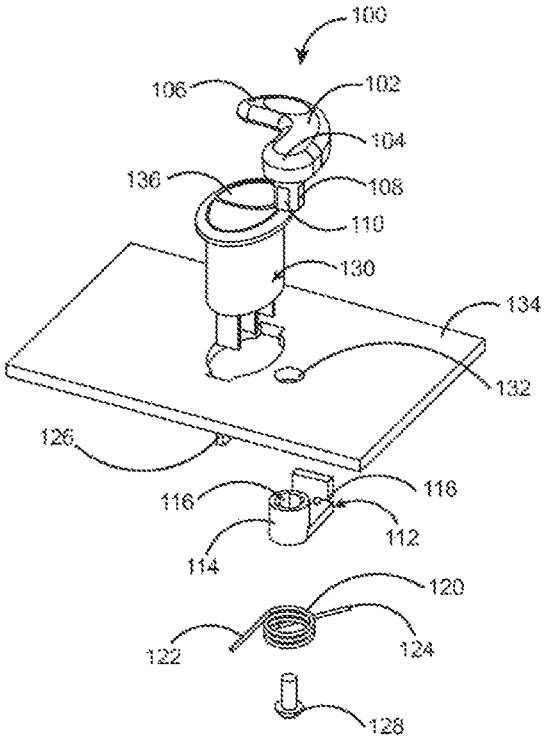
FIG. 1 is an exploded view of a locking assembly including a switch and a panel in accordance with the preferred embodiment of the present invention.

With reference now to FIG. 1, an exploded view of a locking assembly 100 including a switch 130 and a panel 134 will now be discussed. As shown in FIG. 1, the switch 130 with which the locking assembly 100 of the present invention is associated is preferably mounted in the panel 134. In accordance with the preferred embodiment, the switch 130 can generally be oval or rectangular in shape and include a rocker member 136 for turning the switch 130 ON and OFF. The locking assembly 100 may be constructed in such a way as to work with almost any type of rocker switch.

The locking assembly 100 for locking the switch 130 preferably includes a locking member 102 connected to a support member 108, a lower receiving element 112, a retaining tab 126, a resilient member 120 having a first end 122 and a second end 124 and a fastening element 128.

As shown, the locking member 102 is preferably substantially L shaped with a fixed end 104 and a movable end 106. According to a preferred embodiment, the fixed end 104 is preferably thicker than the movable end 106 such that the lower surface of the movable end is further from the surface of the panel 134 when the locking member is positioned above the panel 134. Preferably, the difference between the thickness of the fixed end 104 and the thickness of the movable end 106 is sufficient to allow the movable end 106 to be cantilevered to slide over a portion of the switch 130 when the switch 130 is in the OFF position without allowing the fixed end 104 to do the same.

As further shown in FIG. 1, the fixed end 104 of the locking member 102 is preferably fixedly connected to the support member 108. According to a preferred embodiment, the fixed end 104 and the support member 108 may be two different portions of a single molded piece or may be two independent pieces which are fixed or glued together. The support member 108 may generally be cylindrical in shape and may include one or more projections 110. Preferably, the support member 108 is adaptable to a slide through a hole 132 of the panel 134 and attach with the lower receiving element 112. The support member 108 preferably further includes a screw hole (not shown) or the like to receive a fastening element 128. The fastening element 128 preferably extends through the lower receiving element 112, the support member 108 and into the fixed end 104 of the locking member 102 so that the group of elements are secured to the panel 134.

According to a preferred embodiment, the receiving element 112 and the locking member 102 are mechanically engaged with resilient member 120 such that the spring (or other mechanism of the resilient member 120) applies and maintains a force which pushes or biases the movable end 106 of the locking member 102 in the direction of the rocker member 136. Preferably, the force applied by the resilient member 120 is a torsion force created by a torsion spring or the like. According to a further preferred embodiment, the resilient member 120 is a helical torsion spring which applies sideways forces (bending moments) to its ends to create torsion.

As discussed further below, the resilient member 120 preferably includes a first end 122 which applies sideways forces to the retaining tab 126 and a second end 124 which applies sideways forces to the spring groove 118 of the lower receiving element 112. In response to the force applied to the spring groove 118, the lower receiving element 112 preferably translates the sideways force through the support member 108 to the locking member 102 to give a pivotal motion to the locking member 102. The pivotal motion of the locking member 102 in turn preferably causes the movable end 106 of the locking member 102 to rotate and slide over the switch 130 thus securing the switch in an OFF position.

According to a further preferred embodiment, the lower receiving element 112 is preferably positioned below the panel 134 such that the securing socket element 114 receives and attaches to the support member 108 connected with the locking member 102. The lower receiving element 112 preferably includes a securing socket element 114 having at least one or more receiving grooves 116. Preferably, the receiving grooves 116 on the lower receiving element 112 are adapted to receive the projection(s) 110 on the support member 108. Further, the locking member 102 with the support member 108 is preferably attached to the lower receiving element 112 by the fastening element 128 from the bottom of the panel 134. According to a further preferred embodiment, the fastening element 128 may be a screw, pin or the like.

Figure 2A:
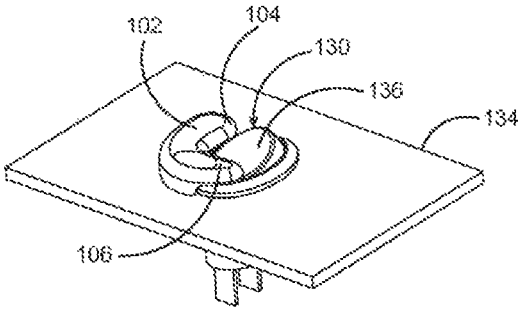
FIG. 2A is a top perspective view of the locking assembly in use when the switch is in the OFF position in accordance with the preferred embodiment of the present invention.
Figure 2B:
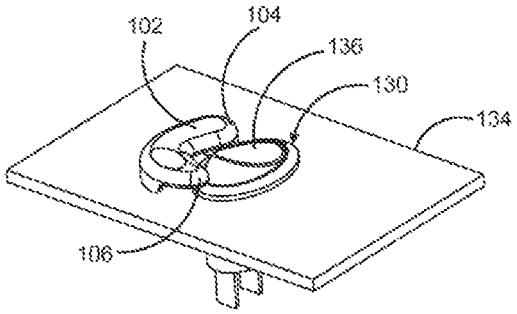
FIG. 2B is a top perspective view of the locking assembly in use when the switch is in the ON position is accordance with the preferred embodiment of the present invention.

Referring now to FIGS. 2A and 2B, two top perspective views of an exemplary locking assembly are provided. In FIG. 2A, the locking assembly is shown with the switch 130 in an OFF position. In FIG. 2B, the locking assembly is shown with the switch 130 in an ON position. As illustrated in FIGS. 2A and 2B, when the switch 130 is OFF, the movable end 106 of the locking member 102 is preferably cantilevered over the part of the rocker member 106 of the switch 130 which is in the downward position as illustrated in FIG. 2A. Preferably, the switch 130 cannot be activated to the ON position until the locking member 102 is rotated away from the rocker member 136. To accomplish this, the user needs to overcome a slight pressure developed by the resilient member 120 that holds the locking member 102 of the lock assembly 100 securely positioned over the rocker member 136, and rotate it out away from the rocker member 136. When the switch 130 is turned ON, the portion of the rocker member 136 adjacent to the movable end 106 of the locking member 102 is in a raised, upward position and the locking member 102 is preferably of sufficient thickness so that it will not extend over the rocker member 136 to restrict its operation as illustrated in FIG. 2B.

Figure 3A:
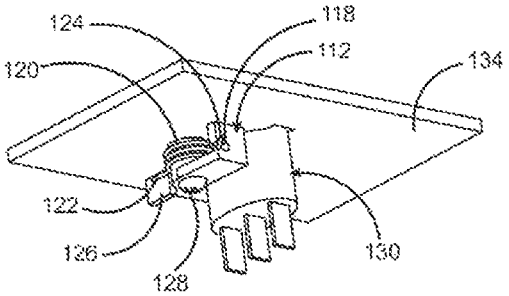
FIG. 3A is a bottom perspective view of the locking assembly when the switch is in the OFF position in accordance with the preferred embodiment of the present invention.
Figure 3B:
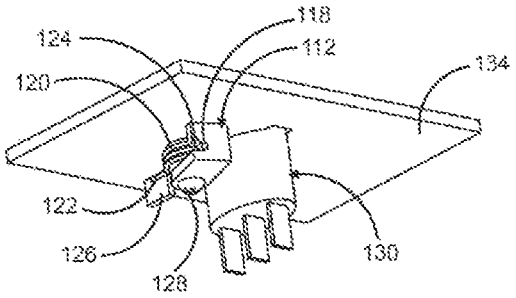
FIG. 3B is a bottom perspective view of the locking assembly when the switch is in the ON position in accordance with the preferred embodiment of the present invention.

FIGS. 3A and 3B illustrate a bottom perspective view of the locking assembly 100 with the switch 130 in the OFF position and ON position respectively in accordance with a preferred embodiment of the present invention. As shown in FIG. 3A, when the switch 130 is OFF, the first and second ends 122, 124 of the resilient member 120 provide torsional force via the retaining tab 126 and the spring groove 118 to bias the lower receiving element 112 so that the attached movable end 106 (shown in FIG. 2A) of the locking member 102 is cantilevered over the part of the rocker member 136 of the switch 130 which is in the downward position (as illustrated in FIG. 2A).

Referring now to FIG. 3B, when the switch 130 is in the ON position, the first and second ends 122, 124 of the resilient member 120 provide torsional force via the retaining tab 126 and the spring groove 118 to bias the lower receiving element 112 so that the movable end 106 (shown in FIG. 2B) of the locking member 102 is against the raised side of the rocker member 136 (as illustrated in FIG. 2B).

Figure 4A:
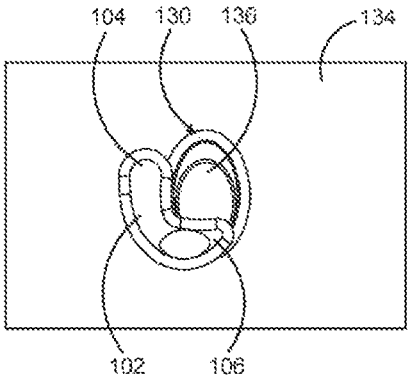
FIG. 4A is a top view of the locking assembly in a LOCKED position in accordance with the preferred embodiment of the present invention.
Figure 4B:
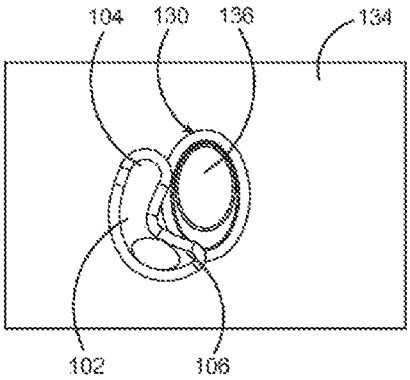
FIG. 4B is a top view of the locking assembly in an OPEN position in accordance with the preferred embodiment of the present invention.

FIGS. 4A-4B illustrate the top views of the locking assembly 100 in the LOCKED and OPEN positions respectively in accordance with a preferred embodiment of the present invention. As shown in FIG. 4A, in the LOCKED position, the movable end 106 of the locking member 102 is cantilevered over the part of the rocker member 136 of the switch 130 which is in the downward position. In the OPEN position, the movable end 106 of the locking member 102 is moved away from the rocker member 136 of the switch 130.

Figure 5A:
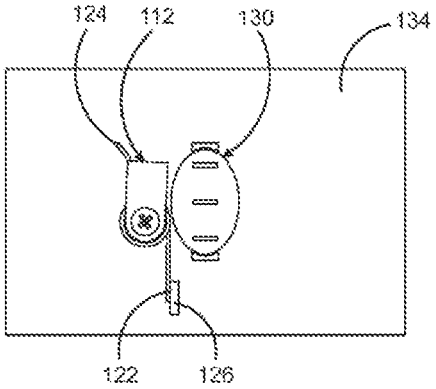
FIG. 5A is a bottom view of the locking assembly when the switch is in the OFF position in accordance with the preferred embodiment of the present invention.
Figure 5B:
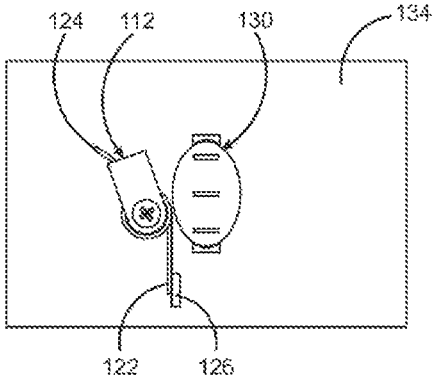
FIG. 5B is a bottom view of the locking assembly when the switch is in the ON position in accordance with the preferred embodiment of the present invention.

FIGS. 5A and 5B illustrate the bottom views of the locking assembly 100 in the LOCKED and OPEN position respectively in accordance with the preferred embodiment of the present invention. Preferably, the switch 130 can be turned OFF without any activation of the locking assembly 100. When the switch 130 is turned OFF, the rocker member 136 is lowered downward eliminating the interference of the locking member 102 with the rocker member 136. The pressure on the resilient member 120 is automatically swiveled over the rocker member 136 and locks the switch 130 again in the OFF position.

As shown in FIG. 5A, when the switch 130 is OFF, the first and second ends 122, 124 of the resilient member 120 (not shown) provide torsional force via the retaining tab 126 and the spring groove 118 (not shown) to bias the lower receiving element 112 so that attached movable end 106 (shown in FIG. 2A) of the locking member 102 is cantilevered over the part of the rocker member 136 of the switch 130 which is in the downward position (as illustrated in FIG. 2A).

Referring now to FIG. 5B, when the switch 130 is in the ON position, the first and second ends 122, 124 of the resilient member 120 (not shown) provide torsional force via the retaining tab 126 and the spring groove 118 (not shown) to bias the lower receiving element 112 so that the movable end 106 (shown in FIG. 2B) of the locking member 102 is secured against the raised side of the rocker member 136 (as illustrated in FIG. 2B).

As detailed above, the locking assembly 100 of the present invention provides a locking mechanism for switches. The locking assembly 100 compels the user to perform a secondary operation to turn ON the switch 130 thereby providing safety to the user and the appliances connected across the switch 130. When the switch 130 is turned OFF, the locking assembly 100 preferably automatically resets to the LOCK position without any additional operation. The person skilled in the art will thus understand that the locking assembly 100 of the present disclosure can be used with various switches.

The foregoing description of the preferred embodiment of the present invention has been resented for the purpose of illustration and description. It is not intended to be exhaustive or to limit the invention to the precise form disclosed. Many modifications and variation are possible in light of the above teachings. It is intended that the scope of the present invention not be limited by this detailed description, but by the claims and the equivalents to the claims appended hereto.

What is claimed is:

1. A locking assembly for locking a switch attached to a panel having at least a first hole for allowing the switch to extend through the panel and a second hole, further wherein the switch is a rocker switch having a rocker member which is movable between an ON position and an OFF position, wherein the locking assembly comprises:

a locking member, wherein the locking member comprises a first section and a second section; wherein the first section is at a first height above the surface of the panel and the second section is at a second height above the surface of the panel; wherein the second height is greater than the first height; further wherein the second section is cantilevered over the rocker member when the switch is in an OFF position; further wherein the second section is not cantilevered over the rocker member when the switch is in an ON position;

a support member, wherein the support member is attached to the locking member at a substantially perpendicular angle; further wherein support member passes through the second hole in the panel; further wherein the support member further comprises at least one projection;

a lower receiving element, wherein the lower receiving element comprises: a securing socket comprised of at least one receiving groove; wherein the lower receiving element is located below the panel; further wherein the securing socket is configured to receive the supporting member; further wherein the at least one projection of the supporting member is inserted within the receiving groove of the lower receiving element; further wherein the lower receiving element preferably further includes at least a retaining tab and a spring groove;

a resilient member, wherein the resilient member comprises a center portion, a first end and a second end; wherein the securing socket passes through the center portion of the resilient member; further wherein the first end of the resilient member provides a sideways force to the retaining tab; further wherein the second end of the resilient member is located within the spring groove of the lower receiving element; and a fastening element, wherein the fastening element is inserted through the lower receiving element and into the support member thereby securing the lower receiving element to the support member; wherein the resilient member is positioned between the lower receiving element and the support member;

wherein, when the switch is in the OFF position, the first and second ends of the resilient member provide a torsional force via the retaining tab and the spring groove to the lower receiving element so that the attached movable end of the locking member is cantilevered over the rocker member.

2. The apparatus of claim 1, wherein the support member is cylindrical.

3. The apparatus of claim 2, wherein the resilient member is a torsion spring.

4. The apparatus of claim 3, wherein the fastening element is a screw.

5. The apparatus of claim 3, wherein the fastening element is a pin.

6. The apparatus of claim 3, wherein the resilient member is a helical torsion spring.

* * * * *